US006912858B2

(12) United States Patent
White

(10) Patent No.: US 6,912,858 B2
(45) Date of Patent: Jul. 5, 2005

(54) METHOD AND SYSTEM FOR PUMPING A CRYOGENIC LIQUID FROM A STORAGE TANK

(75) Inventor: Norman Henry White, Tonawanda, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/661,550

(22) Filed: Sep. 15, 2003

(65) Prior Publication Data

US 2005/0056027 A1 Mar. 17, 2005

(51) Int. Cl.[7] ..... F17C 9/02
(52) U.S. Cl. ..... 62/50.5
(58) Field of Search ..... 62/50.2, 50.4, 62/50.5; 165/142

(56) References Cited

U.S. PATENT DOCUMENTS 3,858,404 A * 1/1975 Davis ..... 62/49.2
4,059,424 A * 11/1977 Bentz ..... 62/49.2
4,546,609 A * 10/1985 Roullet et al. ..... 62/49.2
4,768,356 A * 9/1988 Volker ..... 62/51.1
5,101,636 A * 4/1992 Lee et al. ..... 62/48.1
5,142,875 A * 9/1992 James et al. ..... 62/50.5
5,151,119 A * 9/1992 Clements et al. ..... 65/84
5,154,061 A * 10/1992 Weisshaar ..... 62/606
5,477,691 A * 12/1995 White ..... 62/50.2
5,513,961 A * 5/1996 Engdahl et al. ..... 417/313
5,579,646 A * 12/1996 Lee ..... 62/50.2
6,047,553 A * 4/2000 Germain ..... 62/50.1
6,474,078 B2 * 11/2002 Chalk et al. ..... 62/50.5

FOREIGN PATENT DOCUMENTS

JP 4011296074 A * 11/1989
JP 406159827 A * 6/1994

* cited by examiner

*Primary Examiner*—William Doerrler
*Assistant Examiner*—Mohammad M. Ali
(74) *Attorney, Agent, or Firm*—David M. Rosenblum

(57) ABSTRACT

A cryogenic liquid stream from a storage tank to be pumped is passed through the heat exchanger located within a phase separator vented to atmosphere and a subsidiary cryogenic stream is divided out of the cryogenic liquid stream and is diverted to the phase separator prior to a pump. Low pressure maintained within the phase separator causes the subsidiary cryogenic stream to boil off and form a liquid fraction that covers the heat exchanger. The liquid fraction, which is at a sufficiently low temperature, subcools the cryogenic stream passing through the heat exchanger. Flow of the subsidiary cryogenic stream is suspended when the height of the liquid fraction reaches a predetermined level and is reestablished when the level falls due to boil off. During periods of suspended flow, flow is temporarily reinitiated to prevent the accumulation of warm liquid and vaporized liquid near or at the inlet to the pump.

10 Claims, 1 Drawing Sheet

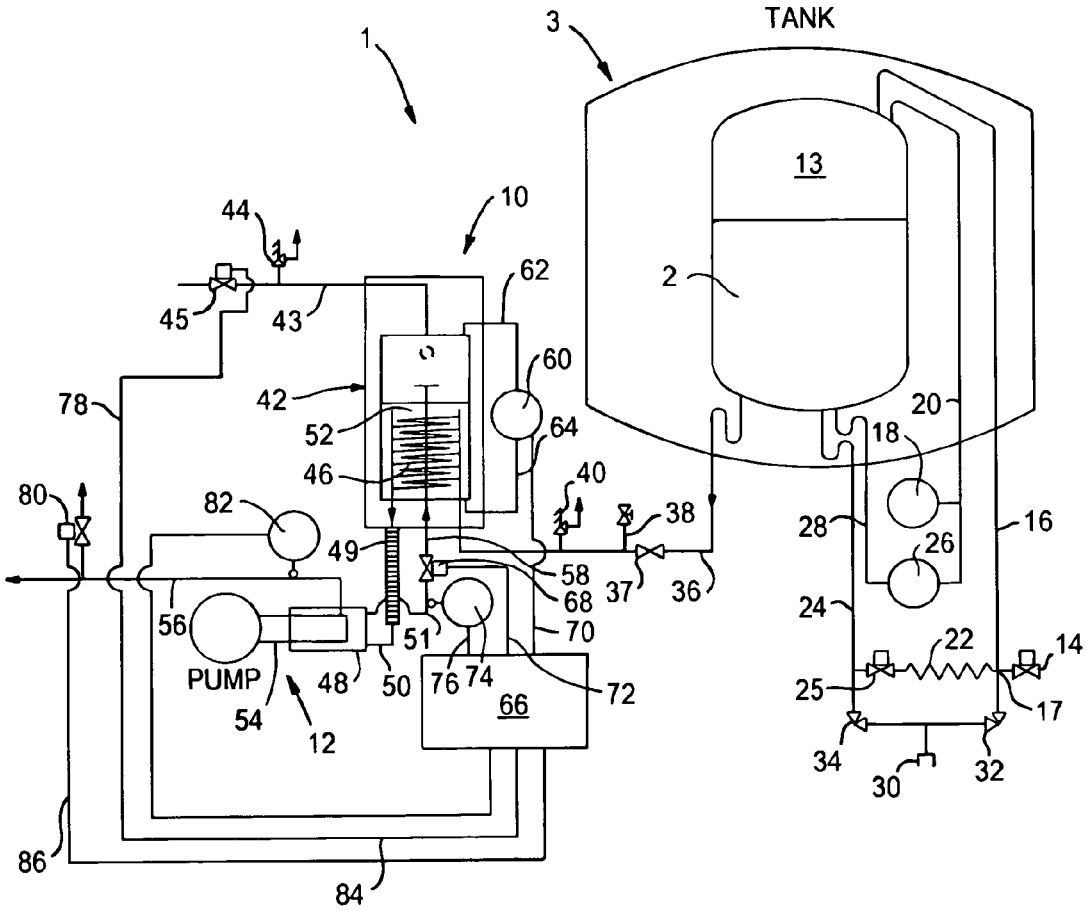
TANK
PUMP
1
2
3
10
12
13
14
16
17
18
20
22
24
25
26
28
30
32
34
36
37
38
40
42
43
44
45
46
48
49
50
51
52
54
56
58
60
62
64
66
68
70
72
74
76
78
80
82
84
86

METHOD AND SYSTEM FOR PUMPING A CRYOGENIC LIQUID FROM A STORAGE TANK

FIELD OF THE INVENTION

The present invention relates to a method and system for pumping a cryogenic liquid from a storage tank in which a cryogenic liquid stream of the cryogenic liquid to be pumped is subcooled prior to pumping. More particularly, the present invention relates to such a method and system in which part of the cryogenic liquid stream is introduced into a phase separator to produce a cool liquid fraction that is used to subcool a remaining portion of the cryogenic liquid stream that passes through a heat exchanger covered by the liquid fraction.

BACKGROUND OF THE INVENTION

Gases that are normally distributed and stored as cryogenic liquids, for instance, atmospheric gases such as nitrogen or compressed natural gas, are sometimes required at pressures exceeding working pressures that can practically be obtained in conventional storage tanks. In such cases a reciprocating pump is used to pressurize a liquid stream removed from the storage tank prior to vaporization of the liquid. Typically, the pump remains idle most of the time but can be started several times during each operating day for periods of up to several hours.

When a cryogenic liquid stream is withdrawn from a storage vessel for purposes of pumping the liquid, the liquid will tend to at first vaporize as the piping connecting the storage tank to the pump and the pump itself are cooled to cryogenic temperature. Additionally, heat is also added to the liquid by the pump due to friction within the moving parts of the pump. If the vaporization occurs before or within the pump, it may prevent priming or cause of loss of prime. Heat added to the fluid to be pumped affects pump performance because of the drop in density. Vaporization causes cavitation, loss of pumping efficiency and accelerated pump wear.

In order to avoid vaporization of the liquid it is known to first subcool the liquid to be pumped. Secondly it is known to provide a supplementary flow in the supply line over and above the pump displacement to clear warm and vaporized liquid that tends to accumulate at the pump inlet regardless of the subcooling available.

In the prior art, subcooling has been done by increasing the static pressure above the body of liquid in the storage tank. For instance, in U.S. Pat. No. 2,850,882, this is accomplished with an external pressure building circuit in which liquid is vaporized and then returned to the head space of the tank so that the liquid pressure is increased. This approach has the distinct disadvantage that the heat added to the tank in the pressure building process is over time transferred to the liquid phase, raising its temperature. As a result, pressure must be continually raised to maintain subcooling until the pressure limit of the storage tank is reached. At that point the storage tank must be blown down to recool the liquid and the tank repressuized. The loss of product in this process is amplified because the temperature of the storage tank metal must also be cycled. In this patent the supplementary flow is established by connecting the pump sump to the gas phase of the tank. This works well when the tank is nearly full since only a small warming of the return liquid is required to establish the circulation flow.

However as the tank level is reduced the circulation flow slows until it is insufficient to keep the pump running properly.

U.S. Pat. No. 5,218,827 takes advantage of the normal stratification that is found in storage tanks. Such stratification results in subcooled liquid at the bottom center of the tank and saturated liquid at peripheral regions of the tank. In order to maintain the stratification, subcooled liquid to be pumped is drawn from the center of the tank and from a lower extension of the tank to maintain pressurization of the liquid. Warmed and vaporized liquid is returned from a sump associated with the pump to the periphery of the tank. In this manner stratification is maintained while also maintaining a circulation of liquid to maintain the delivery line from the tank to the pump and the pump itself in a sufficiently cool condition to prevent vaporization of the liquid. This approach represents an improvement over the prior art because the circulation flow is independent of liquid level. The limitation of this invention is that the amount of subcooling established minimal compared to the requirement of the pump.

Another possibility is to subcool the liquid in a known subcooling unit such as disclosed in U.S. Pat. No. 4,716,738. In this patent, liquid to be distributed to use points is split into two streams. It is to be noted that the use points are not pumps. One stream is vented at atmospheric pressure within a phase separator. The venting causes a cool liquid fraction to collect within the phase separator. At the same time, the other of the two streams flows through a coiled heat exchanger submerged within the liquid fraction. The liquid flowing within the heat exchange coil transfers heat to the cooler liquid fraction within the phase separator thereby to subcool the liquid. The resultant subcooled liquid can be dispensed to a variety of use points. The problem with using such a device in connection with a pump is that when the liquid level is at a sufficient height, flow to the vent is cut off. As a result, any inevitable vapor formation or warm liquid at the inlet of the pump will tend to accumulate and thereby cause a decrease in pumping efficiency.

As will be discussed, the present invention provides a method of pumping a liquid from a storage tank and a system for pumping such a liquid in which the liquid can be subcooled to any required level at or near the pump inlet by a subcooling unit that is specifically designed to provide a supplementary flow of liquid to clear any vapor or warm liquid that accumulates near the pump inlet.

SUMMARY OF THE INVENTION

The present invention provides a method of pumping a cryogenic liquid from a storage vessel in which a cryogenic liquid stream is removed from the storage vessel. At least a portion of the cryogenic liquid stream is pumped. Prior to the pumping of the at least portion of the cryogenic liquid stream, the cryogenic liquid stream is introduced into a heat exchanger located in a phase separator. A subsidiary cryogenic stream is diverted from the cryogenic liquid stream after passage of the cryogenic liquid stream through the heat exchanger. The subsidiary cryogenic liquid stream is introduced into the phase separator and subjected to a lower pressure than that of the storage vessel so as to cause a subsidiary cryogenic stream to boil and produce a boiling pool of a liquid fraction of the subsidiary cryogenic stream that covers the heat exchanger. The liquid fraction has a sufficiently lower temperature than the cryogenic liquid stream to cause the cryogenic liquid stream passing through the heat exchanger be become subcooled. A flow rate of the subsidiary cryogenic liquid stream is controlled by suspending the flow when the liquid fraction is at a predetermined level, above that of the heat exchanger. Flow is reestablished after the liquid level of the liquid fraction has fallen due to the boil off thereof. Between the suspension of the flow and reestablishment thereof, temporarily reestablishing the flow to remove warm and vaporized liquid.

The flow of the subsidiary cryogenic stream can be controlled by sensing a temperature referable to inlet temperature conditions at the inlet of the pump and temporarily reestablishing the flow of the subsidiary cryogenic stream when suspended if the temperature exceeds a predetermined value indicative that warm and vaporized liquid has formed at the inlet of the pump.

The flow of the subsidiary cryogenic stream can also be controlled by constraining a flow rate of the subsidiary cryogenic stream to be substantially equal to a rate at which the liquid fraction is lost from the pool through boiling.

The advantage of the present invention is that it does not require the maintenance of subcooling within the liquid storage tank and the supply lines leading to the pump because the liquid to be pumped is subcooled at or near the pump. Furthermore, the control of the flow of the liquid to the subcooling unit clears warm and vaporized liquid that tends to accumulate near the pump inlet regardless of the subcooling available.

The subsidiary cryogenic stream can be diverted from the cryogenic liquid stream in a sump jacket of a pump used in pumping the at least portion of the liquid stream. In this regard, normally it is only a portion of the cryogenic liquid stream that is pumped in that a subsidiary cryogenic stream that is made up of the cryogenic liquid stream is diverted to the phase separator for producing the cool liquid fraction. However, at times when the phase separator becomes filled with liquid, it is necessary to cut off the flow and therefore the entire cryogenic liquid stream will be pumped until boil off in the phase separator causes a resumption of the flow of the cryogenic stream to the phase separator. During periods of flow, any vapor will vent and when flow is cut off, by preventing warm and vaporized liquid from collecting at or near the inlet of the pump, problems involving loss of pump efficiency due to loss of subcooling will be prevented.

In another aspect, a pumping system for pumping a cryogenic liquid from a storage vessel is provided that utilizes a subcooling unit. The subcooling unit has a phase separator having a vent to maintain the phase separator at a lower pressure than that of the storage vessel and a heat exchanger located within the phase separator. A pump is provided for pumping at least a portion of the cryogenic liquid stream from the storage vessel. The heat exchanger is connected between the pump and the storage vessel such that the cryogenic liquid stream passes through the heat exchanger prior to the pump. The pump is connected to the phase separator such that a subsidiary cryogenic stream is diverted from the cryogenic liquid stream to the phase separator and is subjected to the lower pressure within the phase separator. This causes the subsidiary cryogenic stream to boil and produce a boiling pool of a liquid fraction of the subsidiary cryogenic stream that covers the heat exchanger. This boiling liquid fraction has a sufficiently lower temperature than the cryogenic liquid to subcool the cryogenic liquid stream passing through the heat exchanger.

A liquid level detector can be located within the phase separator to generate signals referable to a height of the liquid fraction within the phase separator. A remotely operated valve can be interposed between the pump and the phase separator. A temperature transducer can be provided to generate temperature signals referable to temperature. The temperature transducer is situated such that the temperature is indicate of temperature conditions at the inlet of the pump. A control system can be provided that is response to the signals generated by the liquid level detector and the temperature signals to operate the remotely operated valve. The control system so operates the remotely operated valve to assume a closed position, suspending the flow, when the height of the liquid fraction it at a predetermined level above the heat exchanger and to assume an open position, reestablishing the flow, after the height of the liquid fraction has fallen due to boil off of the liquid fraction. The control system also operates the remotely operated valve to temporarily assume the open position in response to a temperature indicative that warm liquid and vapor has formed at the inlet of the pump.

An orifice, interposed between the pump and the phase separator, can be sized to control a flow rate of the subsidiary cryogenic stream so that the subsidiary flow rate is substantially equal to a rate at which the liquid fraction is lost from the pool through boiling. Alternatively, the remotely operated valve can be a proportional valve. The controller is responsive to the signals generated by the liquid level detector to control the proportional valve so that a flow rate of the subsidiary cryogenic stream is substantially equal to a rate at which the liquid fraction is lost from the pool through boiling.

In any aspect of the present invention, the pump can be provided with a sump jacket connected to the heat exchanger and phase separator so that the cryogenic liquid stream flows from the heat exchanger to the sump jacket and the subsidiary cryogenic stream is diverted from the sump jacket to the phase separator.

Moreover, in any aspect of the present invention, an off-loading valve can be provided in communication with an outlet of the pump. The off-loading valve has a closed and open discharge portion to allow the pump to discharge to low pressure. The control system is connected to the pump in the off-loading valve. The control system is also configured to activate the pump when the liquid level of the liquid fraction covers the heat exchanger and the temperature is at or below a temperature setpoint at or below the sufficiently lower temperature and to set the off-loading valve in the open discharge position to allow the pump to discharge to a low pressure to ensure the pump itself is cool and thereafter to set the off-loading valve to the closed position so that the cryogenic liquid stream is pumped to a use point.

Where the pump has a sump jacket connected to the heat exchanger and the phase separator, the temperature transducer can be interposed between the sump jacket and the phase separator to sense the temperature of the subsidiary cryogenic stream.

BRIEF DESCRIPTION OF THE DRAWING

While the specification concludes with claims distinctly pointing out the subject matter that Applicant regards as his invention, it is believed that the invention will be better understood when taken in connection with the accompanying drawings in which the sole FIGURE is a schematic sectional view of a pumping system for carrying out a method in accordance with the present invention.

DETAILED DESCRIPTION

With reference to the FIGURE, a system 1 is illustrated for pumping a cryogenic liquid 2 stored in a storage tank 3.

Storage tank 3 is preferably double walled and contains vacuum insulation in order to minimize heat leakage into storage tank 3. Cryogenic liquid 2 can have a varying state from saturated to subcooled or a stratified combination of the two states. The cryogenic liquid 2 is subcooled within a subcooling unit 10 and then pumped by a pump 12 after having been subcooled.

The pressure of thin storage tank 3 is held constant by venting head space vapor 13 through a vent valve 14 in communication with the head space by vent line 16 at a junction 17. The amount of heat removed from storage tank 3 will always be less than the environmental heat leak when pump 12 is operating because pump 12 will also remove heat from the tank. Vent valve 14 is controlled by pressure transducer 18 which senses the pressure of head space vapor 13 by way of an instrument line 20.

When pressure within tank 3 falls below a predetermined amount, for instance, 120 psig, pressure may be built by a pressure building coil 22 which receives cryogenic liquid from a liquid line 24 and vaporizes the same. The vaporized liquid is returned through junction 17 and vent line 16 to the head space of storage tank 3. The flow of liquid from liquid line 24 to pressure building coil 22 is controlled by a remotely operated valve 25 that is activated by pressure as measured by pressure transducer 18. Although not illustrated, the control functions necessary to operate vent valve 14 and remotely operated valve 25 can be incorporated into a controller 66 that will be discussed in greater detail hereinafter or by a separate known controller dedicated to storage tank 3.

The level of liquid within tank 3 is conventionally determined using a differential pressure transducer 26 in which the liquid pressure is sensed by an instrument line 28 and the pressure of vapor 13 is sensed by instrument line 20. Storage tank 3 is filled in a conventional manner through coupling 30. Pressure in the tank is increased or decreased during the course of the fill by opening valves 34 and 32, respectively.

A cryogenic liquid stream is delivered to subcooler unit 10 by way of liquid cryogen delivery line 36. Liquid cryogen delivery line 36 is provided with an isolation valve 37 to cut off the flow, a manually operated vent valve 38 and a safety valve 40. If maintenance is to be performed on pump 12, isolation valve 37 is closed and vent valve 38 is set in an open position to vent trapped vapor.

Subcooler unit 10 is provided with a phase separator 42 that is of double walled construction and that is provided with vacuum insulation between the double walls. Phase separator 42 is vented to atmosphere by a vent line 43 having a safety valve 44 to protect the phase separator 42 from overpressure and a remotely activated vent valve 45 that is sized to maintain the pressure within phase separator 42 as close to 0 psig as possible.

A heat exchanger 46 having straight through passages to prevent fluid flow losses is located within phase separator 42 and is connected to cryogenic liquid line 36 to receive the cryogenic liquid stream. The cryogenic liquid stream is subcooled as it passes through heat exchanger 46 in a manner that will be described hereinafter. The cryogenic liquid stream after having been subcooled is introduced into a sump jacket 48 of pump 12. As illustrated, a vacuum insulated flex hose 49 is provided for such purpose. A coupling 50 is provided to disconnect pump 12 from flex hose 49.

A subsidiary cryogenic stream is divided out of the cryogenic liquid stream by provision of cryogenic line 51 communicating between sump jacket 48 and the interior of phase separator 42. As illustrated, cryogenic line 51 extends to a location above that of heat exchanger 46. After the subsidiary cryogenic stream is introduced into phase separator 42, it is subjected to the low pressure maintained therein which causes boiling of the cryogenic liquid to produce a vapor fraction which is vented through vent line 43 and a liquid fraction 52. The liquid fraction 52 has a sufficiently lower temperature than the cryogenic liquid stream entering heat exchanger 46 that the cryogenic liquid stream is subcooled after passage through heat exchanger 46. The remainder of the cryogenic liquid contained within sump jacket 48 is pumped within pumping chambers 54 of pump 48 and out of a discharge line 56.

Although not illustrated pump 12 would have pistons within the pumping chambers 54 and a drive for the pistons as well as certain known accessory equipment used in connection with pump 12. As can be appreciated, pump 12 could alternatively be a rotary pump of known construction.

The liquid fraction 52 that covers heat exchanger 46 itself will boil due to boiling of the subsidiary cryogenic stream passing through cryogenic line 51 and heat leakage into phase separator 42, and heat transferred from heat exchanger 46. In order to replace the liquid fraction and to ensure a continued flow through cryogenic line 51, an orifice 58 is placed within cryogenic line 51 to control flow of the subsidiary cryogenic stream so that the flow rate of such stream is constrained to at least equal the rate of boil off. As may be appreciated, depending upon environmental temperature conditions, the size of the orifice 58 may have to be varied by geographical location and season. The continued flow of the cryogenic stream will help ensure that there will be no vapor produced at the inlet of pump 12. It is possible to size the orifice 58 to produce a greater flow rate than that is required to replace the liquid fraction. This will, however, produce more aggressive control of the height of the liquid fraction as discussed hereinafter.

In order to maintain a predetermined level of liquid fraction 52 within phase separator 42, a differential pressure transducer 60 is connected by instrument lines 62 and 64 to the top and bottom of phase separator 42, respectively, to generate electrical signals referable to the height of liquid fraction 52. If the height of liquid fraction 52 rises above a predetermined set level covering heat exchanger 46, a controller 66, which is programmed to control a remotely actuated valve 68 within cryogenic line 51 in response to such electrical signals, controls remotely operated valve 68 to assume a closed position to cut off the flow. When the height of liquid fraction falls below a lower set point due to boil off of the liquid fraction, controller 66 controls remotely operated valve 68 to assume an open position to reestablish flow within cryogenic line 51. An alternative control scheme is when flow is cut off, controlling remotely operated valve 68 to assume the open position after a set time interval. Electrical conductors 70 and 72 connect differential pressure transducer 60 and remotely actuated valve 68, respectively, to controller 66.

In case of valve closure of remotely operated valve 68, it is not assured that warm liquid and vaporized liquid will not collect at or near the inlet of pump 12, which in the illustrated embodiment would be within sump jacket 48, due to such transients as intermittent pump operation and the fact that vapor may collect within cryogenic line 51. In order to prevent any vapor from collecting, a temperature transducer 76 is provided to sense temperature within cryogenic line 51 that is also connected to an input of controller 66 by electrical conductors 78. The temperature measured by temperature transducer 74 is referable to the temperature within sump jacket 48 and therefore is indicative of temperature conditions at the inlet of pump 12. Controller 66 is programmed to temporarily open remotely operated valve 68 to assume the open position when the temperature indicates that warm liquid, that is liquid that has lost its subcooling or vaporized liquid has formed at the inlet of pump 12.

For instance, assuming that the pressure of storage tank 3 is 100 psig and liquid nitrogen were to be pumped, the temperature of the cryogenic liquid stream after subcooling could typically be about 153° R. Since saturation temperature under such conditions is about 180° R., about 27° R. subcooling, the temperature set point for temporarily opening remotely operated valve 68 could be 175° R. to provide a sufficient allowance for performance.

An alternative control scheme is when remotely operated valve 68 is closed to temporarily open remotely operated valve 68 periodically at a set time interval to blow off any collected vapor. In such case, there would be no need for temperature sensing for the aforesaid purposes.

In order to start pump 12, valves 68 and 45 are set in open positions. In this regard, this can be done through known additional programming of controller 66. In case of valve 45, a conductor 74 is provided for such purpose. The opening of the aforesaid valves establish a flow of cryogenic liquid through cryogenic liquid supply line 36, heat exchanger 46 and sump jacket 48 and the cryogenic stream through cryogenic line 51. When the liquid level of the liquid fraction 52 reaches the predetermined level as sensed by differential pressure transducer 60, controller 66 can be additionally programmed to react to the temperature sensed by transducer 76. If such temperature indicates a predetermined temperature indicating that the pump 12 is in a sufficiently cooled condition, pump 12 is started by action of controller 66. Although not illustrated, controller 66 could be connected to the power supply of pump 12 for such purposes.

Optionally, an off-loading valve 80 can be provided within pump discharge line 56. Off loading valve 80 can also be connected to controller 66 by conductors 86 for remote operation. When pump 12 is started, controller 66 can also activate off loading valve 80 to assume an open discharge position for approximately 30 seconds to allow pump 12 to discharge at low pressure. The discharge can be routed back to cryogenic storage tank 3 or discharged to atmosphere. The discharge will thoroughly cool the pumping chamber 54 within pump 12. Off-loading valve 80 after the preset time interval can be closed to allow liquid within pump discharge line 56 to be sent to the use point.

A temperature transducer 82 can be provided in pump discharge line 56 to measure pump discharge temperature which is roughly proportional to the volumetric efficiency. It is a common method to determine whether pump 12 is primed. Temperature would be determined empirically for the system and is dependent upon discharge pressure. Temperature will typically range from between about −125° F. and about −200° F. When temperature signals generated by temperature transducer 82 indicate that the temperature has fallen above such a range, it can be assumed that the pump has lost prime. These temperature signals are sent to controller 66 as an input through electrical conductors 84. The controller 66 can be programmed such that in response to temperature signals indicative that the pump has lost its prime, controller 66 turns off pump 12.

In an alternative embodiment, valve 68 could be replaced with a proportional valve. In such case orifice 58 would be deleted. If remotely operated valve 68 were a proportional valve, controller 66 would be programmed to react to the level of liquid fraction 52 to adjust the opening of the valve 68 to maintain the height of liquid fraction 52 at the predetermined level. This would allow the flow within cryogenic line 51 to nearly always exist as the flow rate of the subsidiary cryogenic stream would be substantially equal to the boil off rate of the liquid fraction. Temperature referable to inlet conditions of pump 12 could also be sensed to ensure the opening of the valve if the temperature level were indicative of warm liquid or vaporized liquid within sump jacket 48.

It is to be noted that programming functions of controller 66 are well known by those skilled in the art, for instance, liquid level, temperature, and pressure control. It is also to be noted, that timer relay control is equally possible.

While the present invention has been described with reference to a preferred embodiment, as will occur to those skilled in the art, numerous changes, additions and omissions may be made without departing from the spirit and scope of the present invention.

I claim:

1. A method of pumping a cryogenic liquid from a storage vessel comprising:

removing a cryogenic liquid stream from said storage vessel;

pumping at least a portion of the cryogenic liquid stream;

prior to the pumping of the at least a portion of the cryogenic liquid stream, introducing the cryogenic liquid stream into a heat exchanger located in a phase separator and diverting a subsidiary cryogenic stream from the cryogenic liquid stream after passage of the cryogenic liquid stream through the heat exchanger;

introducing the subsidiary cryogenic stream into the phase separator and subjecting the subsidiary cryogenic stream to a lower pressure than that of the storage vessel so as to cause the subsidiary cryogenic stream to boil and produce a boiling pool of a liquid fraction of the subsidiary cryogenic stream covering the heat exchanger and having a lower temperature than the cryogenic liquid stream, thereby to subcool the cryogenic liquid stream; and controlling flow of the subsidiary cryogenic stream by suspending the flow when the liquid fraction is at a predetermined level, above that of the heat exchanger, reestablishing the flow after liquid level of the liquid fraction has fallen due to the boil off thereof, and between the suspension of the flow and the reestablishment thereof, temporarily reestablishing the flow to remove warm and vaporized liquid.

2. The method of claim 1, wherein the flow of the subsidiary cryogenic stream is controlled by:

sensing a temperature referable to inlet temperature conditions at the inlet of the pump; and temporarily reestablishing the flow of the subsidiary cryogenic stream when suspended if said temperature exceeds a predetermined value indicative that warm and vaporized liquid has formed at the inlet of said pump.

3. The method of claim 1 or claim 2, wherein the flow of the subsidiary cryogenic stream is further controlled by constraining a flow rate of the subsidiary cryogenic stream to be substantially equal to a rate at which the liquid fraction is lost from the pool through boiling.

4. The method of claim 1, wherein the subsidiary cryogenic stream is diverted from the cryogenic liquid stream in a sump jacket of a pump used in pumping the at least a portion of the cryogenic liquid stream.

5. A pumping system for pumping a cryogenic liquid from a storage vessel comprising:

a subcooling unit comprising a phase separator having a vent to maintain the phase separator at a lower pressure than that of the storage vessel and a heat exchanger located within the phase separator;

a pump for pumping at least a portion of a cryogenic liquid stream from said storage vessel;

the heat exchanger connected between the pump and the storage vessel such that the cryogenic liquid stream passes through the heat exchanger prior to the pump;

the pump connected to the phase separator such that a subsidiary cryogenic stream is diverted from the cryogenic liquid stream to the phase separator and is subjected to the lower pressure within the phase separator to cause the subsidiary cryogenic stream to boil and produce a boiling pool of a liquid fraction of the subsidiary cryogenic stream covering the heat exchanger and having a sufficiently lower temperature than the cryogenic liquid to subcool the cryogenic liquid stream passing through the heat exchanger;

a liquid level detector located within the phase separator to generate signals referable to a height of the liquid fraction within the phase separator;

a remotely operated valve interposed between the pump and the phase separator to control flow of the subsidiary cryogenic stream;

a temperature transducer to generate temperature signals referable to temperature;

the temperature transducer situated such that the temperature is indicative of temperature conditions at an inlet of the pump; and a control system responsive to the signals generated by the liquid level detector and the temperature signals to operate the remotely operated valve to assume a closed position, suspending the flow, when the height of the liquid fraction it at a predetermined level above the heat exchanger, to assume an open position, reestablishing the flow, after the height of the liquid fraction has fallen due to boil off of the liquid fraction, and to temporarily assume the open position in response to a temperature indicative that warm liquid and vapor has formed at the inlet of the pump.

6. The pumping system of claim 5, further comprising an orifice, interposed between the pump and the phase separator, sized to control a flow rate of the subsidiary cryogenic stream so that the subsidiary flow rate is substantially equal to a rate at which the liquid fraction is lost from the pool through boiling.

7. The pumping system of claim 5, wherein:

the remotely operated valve is a proportional valve; and the controller is responsive to the signals generated by the liquid level detector to control the proportional valve such that a flow rate of the subsidiary cryogenic stream is substantially equal to a rate at which the liquid fraction is lost from the pool through boiling.

8. The pumping system of claim 5 wherein the pump has a sump jacket connected to the heat exchanger and the phase separator so that the cryogenic liquid stream flows from the heat exchanger into the sump jacket and the subsidiary cryogenic stream is diverted from the sump jacket to the phase separator.

9. The pumping system of claim 8, wherein:

an off-loading valve is in communication with an outlet of the pump, the off-loading valve having a closed and an open discharge position to allow the pump to discharge to low pressure;

the control system is connected to the pump and the off-loading valve; and the control system is also configured to activate the pump when the liquid level of the liquid fraction covers the heat exchanger and the temperature is at or below a temperature set point at or below said sufficiently lower temperature and to set the off-loading valve in the open discharge position to allow the pump to discharge to a low pressure to ensure that the pump itself is cooled and thereafter to set the off-loading valve to the closed position so that the cryogenic liquid stream is pumped to a use point.

10. The pumping system of claim 5, wherein:

the pump has a sump jacket connected to the heat exchanger and the phase separator so that the cryogenic liquid stream flows from the heat exchanger into the sump jacket and the subsidiary cryogenic stream is diverted from the sump jacket to the phase separator; and the temperature transducer is interposed between the sump jacket and the phase separator to sense the temperature of the subsidiary cryogenic stream.

* * * * *

UNITED STATES PATENT AND TRADEMARK OFFICE

CERTIFICATE OF CORRECTION

PATENT NO. : 6,912,858 B2
DATED : July 5, 2005
INVENTOR(S) : Norman Henry White

It is certified that error appears in the above-identified patent and that said Letters Patent is hereby corrected as shown below:

Column 9,
Line 37, replace "it at a predetermined", with -- is at a predetermined --.

Signed and Sealed this

Sixth Day of September, 2005

JON W. DUDAS
*Director of the United States Patent and Trademark Office*